US006048657A

United States Patent [19]

Herbert et al.

[11] Patent Number: 6,048,657

[45] Date of Patent: Apr. 11, 2000

[54] SURFACE TREATMENT METHOD WITHOUT EXTERNAL POWER SOURCE

[75] Inventors: William G. Herbert, Williamson; Philip G. Perry; Alexandra I. Vidal, both of Webster, all of N.Y.

[73] Assignee: Xerox Corporation, Stamford, Conn.

[21] Appl. No.: 09/238,286

[22] Filed: Jan. 28, 1999

[51] Int. Cl.[7] ..... G03G 5/10

[52] U.S. Cl. ..... 430/127; 430/69

[58] Field of Search ..... 430/69, 127, 131

[56] References Cited

U.S. PATENT DOCUMENTS

| | | | |
|---|---|---|---|
| 4,076,564 | 2/1978 | Fisher | 430/69 |
| 4,525,249 | 6/1985 | Arora | 204/129.75 |
| 4,606,975 | 8/1986 | Mohr | 428/469 |
| 5,302,485 | 4/1994 | Swain | 430/127 |
| 5,304,298 | 4/1994 | Brenk | 205/106 |
| 5,573,445 | 11/1996 | Rasmussen et al. | 451/39 |
| 5,635,324 | 6/1997 | Rasmussen et al. | 430/58 |
| 5,681,636 | 10/1997 | Marshall | 428/65.3 |
| 5,919,591 | 7/1999 | Senba et al. | 430/127 |

FOREIGN PATENT DOCUMENTS

| | | | |
|---|---|---|---|
| 266448 | 3/1966 | Australia | 430/69 |
| 5-188605 | 7/1993 | Japan | 430/127 |

OTHER PUBLICATIONS

Grant & Hackh's Chemical Dictionary, 1987, p. 205.

*Primary Examiner*—Roland Martin
*Attorney, Agent, or Firm*—Zosan S. Soong

[57] ABSTRACT

There is disclosed a process for forming a photosensitive imaging member including positioning a substrate and an electrode in an electrolytic solution to form a galvanic cell and electrochemically graining the substrate surface in the absence of an external power source to provide a substrate surface roughness sufficient to substantially suppress the formation of a pattern of light and dark interference fringes upon exposure of the photosensitive imaging member to a light source.

7 Claims, No Drawings

SURFACE TREATMENT METHOD WITHOUT EXTERNAL POWER SOURCE

FIELD OF THE INVENTION

This invention relates to a method for forming a photosensitive imaging member where the substrate surface is electrochemically roughened to achieve a surface roughness sufficient to substantially suppress the formation of a pattern of light and dark interference fringes upon exposure of the photosensitive imaging member to a light source.

BACKGROUND OF THE INVENTION

Coherent illumination is being increasingly used in electrophotographic printing for image formation on photoreceptors. Unfortunately, the use of coherent illumination sources in conjunction with multilayered photoreceptors results in a print quality defect known as the "plywood effect" or the "interference fringe effect." This defect consists of a series of dark and light interference patterns that occur when the coherent light is reflected from the interfaces that pervade multilayered photoreceptors. In organic photoreceptors, primarily the reflection from the air/charge transport layer interface (i.e., top surface) and the reflection from the undercoat layer or charge blocking layer/substrate interface (i.e., substrate surface) account for the interference fringe effect. The effect can be eliminated if the strong charge transport layer surface reflection or the strong substrate surface reflection is eliminated or suppressed.

Methods have been proposed to suppress the air/charge transport layer interface specular reflection, including roughening of the charge transport layer surface by introducing micrometer size $SiO_2$ dispersion and other particles into the charge transport layer, applying an appropriate overcoating layer and the like.

Methods have also been proposed to suppress the intensity of substrate surface specular reflection, e.g., coating specific materials such as anti-reflection materials and light scattering materials on the substrate surface and roughening methods such as dry blasting and liquid honing of the substrate surface. However, such methods are often costly and complicated to implement.

Thus, there is a need, which the present invention addresses, for new photoreceptor substrate treatment methods that can reduce the interference fringe effect in a simple and cost effective manner.

The following documents disclose conventional surface treatment methods:

Rasmussen et al., U.S. Pat. No. 5,635,324 (diamond lathing), Swain, U.S. Pat. No. 5,302,485 (roughening using refractory fibers) and Rasmussen et al., U.S. Pat. No. 5,573,445 (liquid honing) disclose methods to suppress the interference fringe effect in photosensitive members.

Brenk, U.S. Pat. No. 5,304,298; Mohr, U.S. Pat. No. 4,606,975; and Arora, U.S. Pat. No. 4,525,249, disclose the etching of substrates by chemical or electrochemical techniques.

SUMMARY OF THE INVENTION

The present invention is accomplished in embodiments by providing a process for forming a photosensitive imaging member comprising positioning a substrate and an electrode in an electrolytic solution to form a galvanic cell and electrochemically graining the substrate surface in the absence of an external power source to provide a substrate surface roughness sufficient to substantially suppress the formation of a pattern of light and dark interference fringes upon exposure of the photosensitive imaging member to a light source.

DETAILED DESCRIPTION

A general description of the present process now follows. To form the galvanic cell, a substrate and a counterelectrode are disposed in an electrolytic solution. The substrate is immersed in the electrolytic solution to the desired substrate length. The substrate is the working electrode and the counterelectrode is made from a passive material that is lower on the electromotive series than the substrate material. The distance between the surface of the substrate and the surface of the counter electrode ranges for example from about 1 cm to about 10 cm. The electrochemical graining of the substrate surface occurs spontaneously in the absence of an external power source since the materials of the substrate and the counterelectrode have dissimilar standard electrode potentials, with the substrate material desirably having a higher standard electrode potential than the counterelectrode. The electrochemical graining occurs pursuant to the following parameters: a self generated voltage ranging for example from about 0.7 to about 2.0 V, and preferably from about 0.9 to about 1.8 V; a temperature of the electrolytic solution ranging for example from about 15° C. to about 90° C., and preferably from about 23° C. to about 70° C.; a time ranging from about 30 seconds to about 10 minutes, preferably from about 1 minute to about 5 minutes. The substrate and the counterelectrode must not be grounded (e.g., set up in a glass or plastic tank) and are in electrical contact with each other.

The electrolytic solution can be subjected to ultrasonic waves during the electrochemical graining for a period of time ranging for example from 30 seconds to about 10 minutes, preferably from about 1 minute to about 5 minutes. Ultrasonic agitation improves uniformity by insuring quick release of gas bubbles and refreshment of electrolyte in the diffusion layer. About 40 KHz is the recommended frequency (lower frequencies may be too aggressive and produce corrosion) preferably with a sweep frequency generator such as that provided by NEY Ultrasonics.

The counterelectrode is fabricated from a passive material including for example carbon, a noble metal such as platinum and palladium, or a mixture such as palladium and titanium (all ratios of palladium and titanium may be acceptable).

The electrolytic solution includes water, preferably deionized water, and an electrolyte. The electrolyte includes for example sodium citrate, triethanolamine and an alkali halogen such as NaCl, NaBr, and KCl at a pH for example of about 6 to about 9. The electrolyte may be present in an amount ranging from about 0.01% to about 10% (weight), preferably from about 0.1% to about 3% (weight).

Any suitable substrate may be treated by the present invention including metal substrates typically employed as photoreceptor substrates such as those fabricated from for example stainless steel, nickel, aluminum, and alloys thereof. Aluminum or aluminum alloy substrates are preferred. Typical aluminum alloys include, for example, 1050, 1100, 3003, 6061, 6063, and the like. Alloy 3003 contains Al, 0.12 percent by weight Si, 0.43 percent by weight Fe, 0.14 percent by weight Cu, 1.04 percent by weight Mn, 0.01 percent by weight Mg, 0.01 percent by weight Zn, 0.01 percent by weight Ti, and a trace amount of Cr. Generally, the surface of the substrate may be relatively smooth prior to the present electrochemical graining. Typical smooth surfaces are formed by, e.g., diamond lathing, specialized extrusion and drawing processes, grinding, buffing and the like prior to the present electrochemical graining. After smoothing but prior to the present electrochemical graining, the substrate surface roughness should be in the range of about $R_a$ of 0.005 micrometers, $R_{max}$ of 0.05 micrometers to about $R_a$ of 0.13 micrometers, $R_{max}$ of 1.3 micrometers. $R_a$ is the arithmetic average of all departures of the roughness profile from the center line within the evaluation length. $R_a$ is defined by a formula:

$$R_a = \frac{1}{l_m}\int_0^{l_m} |y| dx$$

in which $l_m$ represents the evaluation length, and $|y|$ represents the absolute value of departures of the roughness profile from the center line.

The expression $R_{max}$ represents the largest single roughness gap within the evaluation length. The evaluation length is that part of the traversing length that is evaluated. An evaluation length containing five consecutive sampling lengths is taken as a standard.

Typically, the substrate is cylindrical or drum-shaped, and is cleaned by any suitable technique prior to the present electrochemical graining to remove any foreign substances introduced to the surface during any of the aforementioned smoothing processes. Although a cylindrical substrate is preferred, any substrate geometry such as a hollow or solid cylinder, a flat sheet, a seamed or unseamed belt, or any other form that allows the utilization of conventional coating techniques such as dip coating, vapor deposition and the like can be used.

The surface morphology produced by the present method may be defined by the following parameters: $R_a$ (mean roughness), $R_t$ (maximum roughness depth), $R_{pm}$ (mean levelling depth), $W_t$ (waviness depth), and $P_t$ (profile depth), wherein preferred values for minimizing or eliminating the interference fringe effect are described below. $R_a$ is defined above and preferably ranges from about 0.05 to about 0.7 micrometer, more preferably from about 0.1 to about 0.6 micrometer, and most preferably from about 0.10 to about 0.55 micrometer. $R_t$ is the vertical distance between the highest peak and the lowest valley of the roughness profile R within the evaluation length and preferably ranges from about 0.5 to about 6 micrometers, and more preferably from about 0.8 to about 4.5 micrometers. $R_{pm}$ is the mean of five levelling depths of five successive sample lengths and preferably ranges from about 0.2 to about 2 micrometers, and more preferably from about 0.3 to about 1.5 micrometers. $W_t$ is the vertical distance between the highest and lowest points of the waviness profile W within the evaluation length and preferably ranges from about 0.1 to about 1 micrometer, and more preferably from about 0.15 to about 0.5 micrometer. $P_t$ is the distance between two parallel lines enveloping the profile within the evaluation length at their minimum separation and preferably ranges from about 0.8 to about 6 micrometers, and more preferably from about 1 to about 4 micrometers. Significant suppression of the interference fringe effect may be observed in embodiments of the present invention at the light source wavelengths conventionally used, including a light source having a wavelength at 780 nm.

All measurements of the various surface roughness parameters described herein may be made with a profilameter such as Model S8P manufactured by Mahr Feinpruef Corporation. Generally, a stylus with a diamond tip is traversed over the surface of the roughened substrate at a constant speed to obtain all data points within an evaluation length. The radius of curvature of the diamond tip used to obtain all data referred to herein is 5 micrometers.

An alternate method of determining a substrate's propensity to produce or reduce the interference fringe effect involves measuring the "brightness" of the substrate surface before and after the present surface treatment method. This can be accomplished by shining a white light source on the substrate surface and measuring the reflected light using a photodetector having for example an 8 bit charge coupled device (a neutral density light filter may be placed on the photodetector to moderate the light intensity). A computer and appropriate software can then compare the reflected light against a grayscale having for example 256 units. Prior to the present electrochemical graining, the substrate typically has a brightness above about 200 units such as from about 240 to about 250 units. The electrochemical graining reduces the brightness of the substrate surface to below for example about 180 units, preferably from about 140 to about 180 units, and especially from about 160 to about 170 units. The reduced brightness level described herein substantially suppresses or totally suppresses the interference fringe effect.

The present invention offers a number of benefits. For example, the instant method is cheaper than honing or conventional electrochemical treatment. In terms of its operation, the present method offers simplicity and few process controls. In terms of cleaning, the present method enhances cleaning as well as provides a surface having uniform surface energy for improved wetting and subsequent coating thickness control. Also, in embodiments, the present method can create an oxide layer on the substrate surface which can supplement a subsequently deposited charge blocking layer.

In fabricating a photosensitive imaging member, a charge generating material (CGM) and a charge transport material (CTM) may be deposited onto the substrate surface either in a laminate type configuration where the CGM and CTM are in different layers or in a single layer configuration where the CGM and CTM are in the same layer along with a binder resin. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

The photosensitive imaging member produced according to the invention can be tested for print quality assessment in Xerox laser printer model 4213 at an initial charging voltage of about 380 volts. The 4213 laser printer has a 780 nm wavelength laser diode as the exposure source and a single component discharged area development (DAD) system with 11 micrometer toner. Interference fringe effect is tested in a gray scale print mode using specified halftone patterns. The interference fringes, or plywood fringes, are not observed, and no degradation of print quality is observed due to black spots. Similar results may be achieved with other laser-based machines, e.g., those with an exposure light source that operates in the range of 600–800 nm.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE

A solution of the following formulation was prepared for treating an aluminum substrate prior to applying photoconductor coatings:

1% (wt) Sodium Citrate ($Na_3C_6H_5O_7$); and

1% (wt) Sodium Chloride (NaCl).

The salts were thoroughly dissolved in deionized water at a temperature of 40° C.

A 30 mm seamless drawn 3003 aluminum alloy substrate, rough lathed using a diamond tool to a surface having an arithmetic mean roughness ($R_a$) of about 0.15 micrometer and an $R_{max}$ of about 2 micrometer, was immersed in the chemical solution and electrically attached to a 50/50 by weight Pd/Ti alloy electrode forming a galvanic cell. The cylindrical electrode surrounded the substrate with a spacing of approximately 3 cm from the substrate. The temperature of the electrolyte was maintained at 70° C. +/−2° C. and an immersion process time of 3 min. was used. Immediately following the galvanic treatment the substrate was withdrawn, immersion rinsed in ambient deionized water for 1 min., withdrawn, immersed in 70° C. deionized water for 1 min., withdrawn and dried at 60° C. for 3 min. This process produced a uniformly matte etched surface having an aluminum oxide film of about 100 Angstoms as determined via sputtering using Electron Spectroscopy for Chemical Analysis ("ESCA").

The substrate was coated with an about 0.2 micrometer thick charge generating layer of hydroxygallium phthalocyanine ("OHGaPc") and a terpolymer ("VMCH") of: vinyl chloride (86%), vinyl acetate (13%) and maleic acid (1%), dissolved in n-butyl acetate (4.5% solids) in a 60:40 ratio (60 OHGaPc:40 VMCH). Atop the charge generating layer was coated an about 24 micrometer thick charge transport layer of polycarbonate, derived from bis phenyl Z (PCZ400) and N,N'-diphenyl-N,N'-bis(3-methylphenyl)-(1,1'-biphenyl)-4,4'diamine dissolved in tetrahydrofuran.

After coating and drying, the device was copy quality tested in a Xerox DocuCenter 230®. The resulting output copies showed no interference fringe effect.

Comparative Example

The procedures of the Example were used except that a mirror lathed substrate was employed. In addition, the mirror lathed substrate was not chemically treated with the inventive surface treatment method. Also, a blocking layer (about 1 micrometer in thickness) of acetylacetone zirconium tributoxide and gamma-aminopropyltrimethoxysilane was provided on the substrate prior to the deposition of the charge generation and charge transport layers described above. When tested for copy quality, this device showed unacceptable and extensive levels of the copy quality anomaly known as the interference fringe effect.

Other modifications of the present invention may occur to those skilled in the art based upon a reading of the present disclosure and these modifications are intended to be included within the scope of the present invention.

We claim:

1. A process for forming a photosensitive imaging member comprising:

(a) positioning a substrate and an electrode in an electrolytic solution to form a galvanic cell and electrochemically graining the substrate surface in the absence of an external power source to provide a substrate surface roughness defined by $R_a$ ranging from about 0.05 to about 0.7 micrometer, $R_t$ ranging from about 0.5 to about 6 micrometers, $R_{pm}$ ranging from about 0.2 to about 2 micrometers, $W_t$ ranging from about 0.1 to about 1 micrometer, $P_t$ ranging from about 0.8 to about 6 micrometers to substantially suppress the formation of a pattern of light and dark interference fringes upon exposure of the photosensitive imaging member to a light source, and (b) depositing onto the substrate surface (i) a charge generating layer and a charge transport layer in any order, or (ii) a single photoconductive layer.

2. The process of claim 1, wherein the substrate comprises aluminum or stainless steel.

3. The process of claim 1, wherein the electrode comprises a noble metal.

4. The process of claim 1, further comprising lathing the substrate surface prior to the electrochemical graining.

5. The process of claim 1, further comprising directing ultrasonic waves at the electrolytic solution during the electrochemical graining.

6. The process of claim 1, wherein the electrochemical graining occurs at a voltage ranging from about 0.7 to about 2.0 V.

7. The process of claim 1, wherein the electrochemical graining occurs at a temperature ranging from about 15° C. to about 90° C.

* * * * *